US008138947B2

(12) United States Patent
Ichihashi et al.

(10) Patent No.: US 8,138,947 B2
(45) Date of Patent: Mar. 20, 2012

(54) SPEED LIMIT INFORMING DEVICE INSTALLED IN ON-BOARD NAVIGATION SYSTEM

(75) Inventors: Syo Ichihashi, Anjo (JP); Eiji Sobue, Ichinomiya (JP); Yoshihiko Sugawara, Anjo (JP); Atsushi Hayashida, Kariya (JP)

(73) Assignee: DENSO CORPORATION, Kariya (JP)

( * ) Notice: Subject to any disclaimer, the term of this patent is extended or adjusted under 35 U.S.C. 154(b) by 528 days.

(21) Appl. No.: 12/320,547

(22) Filed: Jan. 29, 2009

(65) Prior Publication Data

US 2009/0195411 A1 Aug. 6, 2009

(30) Foreign Application Priority Data

Feb. 5, 2008 (JP) ..... 2008-024812

(51) Int. Cl.
*G08G 1/09* (2006.01)

(52) U.S. Cl. ..... 340/905; 340/901

(58) Field of Classification Search ..... 340/905
See application file for complete search history.

(56) References Cited

U.S. PATENT DOCUMENTS 5,844,505 A * 12/1998 Van Ryzin ..... 340/988
6,388,578 B1 * 5/2002 Fagan et al. ..... 340/901
6,462,675 B1 * 10/2002 Humphrey et al. ..... 340/905
6,472,977 B1 * 10/2002 Pochmuller ..... 340/425.5
6,515,596 B2 * 2/2003 Awada ..... 340/905
6,778,074 B1 * 8/2004 Cuozzo ..... 340/441

FOREIGN PATENT DOCUMENTS

| | | |
|---|---|---|
| EP | 0 982 699 | 3/2000 |
| JP | A-H9-73600 | 3/1997 |
| JP | A-2002-163643 | 6/2002 |
| JP | A-2005-92403 | 4/2005 |
| JP | 2005128790 A * | 5/2005 |
| JP | A-2005-128790 | 5/2005 |
| JP | A-2007-47886 | 2/2007 |
| JP | A-2007-79722 | 3/2007 |
| JP | A-2007-256165 | 10/2007 |

* cited by examiner

*Primary Examiner* — George Bugg
*Assistant Examiner* — Kerri Mcnally
(74) *Attorney, Agent, or Firm* — Posz Law Group, PLC

(57) ABSTRACT

A device for informing to a driver a speed limit set for an own lane included in a multi-lane road is installed in a navigation system mounted on an automotive vehicle. The device includes a road surface camera for taking pictures of the speed limit painted on a road surface and informing devices such as a display panel and/or a speaker. The speed limit set for the own lane is specified based on the pictures taken by the road surface camera, and the specified speed limit is informed to the driver. Speed limits set for neighboring lanes may be also specified, and if they are different from the speed limit set for the own lane, this is informed to the driver together with the speed limits set for the neighboring lanes. It is not required to distinguish the own lane from among other lanes included in the multi-lane road because the speed limit set for the own lane is detected by the camera mounted on the own vehicle.

16 Claims, 4 Drawing Sheets

SPEED LIMIT INFORMING DEVICE INSTALLED IN ON-BOARD NAVIGATION SYSTEM

CROSS-REFERENCE TO RELATED APPLICATION

This application is based upon and claims benefit of priority of Japanese Patent Application No. 2008-24812 filed on Feb. 5, 2008, the content of which is incorporated herein by reference.

BACKGROUND OF THE INVENTION

1. Field of the Invention

The present invention relates to a device for informing a speed limit to a driver, the device being installed in a navigation system mounted on an automotive vehicle.

2. Description of Related Art

An example of a device for informing a speed limit to a driver of an automotive vehicle is disclosed in JP-A-2007-256165. This device is constituted under a presumption that a common speed limit is set for all lanes of a multi-lane road. However, there are multi-lane roads in which a different speed limit is set for each lane. In this case, the device disclosed in JP-A-2007-256165 does not function sufficiently.

SUMMARY OF THE INVENTION

The present invention has been made in view of the above-mentioned problem, and an object of the present invention is to provide an improved device for specifying a speed limit set for each lane in a multi-lane road and for informing the specified speed limit to a driver.

A speed limit informing device according to the present invention is installed in a navigation system mounted on an automotive vehicle. The device includes an on-board camera for taking pictures of a road surface (referred to as a road surface camera), a display panel and/or a speaker for giving information to a driver and a control circuit for controlling operation of the device.

A speed limit set for an own lane, on which an own vehicle is driving, the own lane being included in a multi-lane road, is specified based on pictures taken by the road surface camera. Numerals showing a speed limit painted on the own lane are taken into pictures by the road surface camera, and the control circuit specifies the speed limit from the pictures. The specified speed limit set for the own lane is informed to the driver by displaying it on a display panel or from the speaker.

The speed limit set for the own lane may be also read out from map data stored in an on-board memory device. If the read out speed limit is different from the specified speed limit based on the pictures taken by the road surface camera, this fact is informed to driver. In this case, driver may be recommended to update the map data stored in the on-board device. Speed limits set for lanes neighboring to the own lane may be also detected by the road surface camera. If the speed limits of the neighboring lanes are different from that of the own lane, the driver is informed to this effect together with the speed limits set for the neighboring lanes.

According to the present invention, it is not necessary to specify the own lane from among other lanes in the multi-lane road because the speed limit of the own lane is detected by the road surface camera mounted on the own vehicle. Further, the speed limits set for the neighboring lanes are easily detected. Other objects and features of the present invention will become more readily apparent from a better understanding of the preferred embodiment described below with reference to the following drawings.

DETAILED DESCRIPTION OF THE PREFERRED EMBODIMENT

Figure 1:
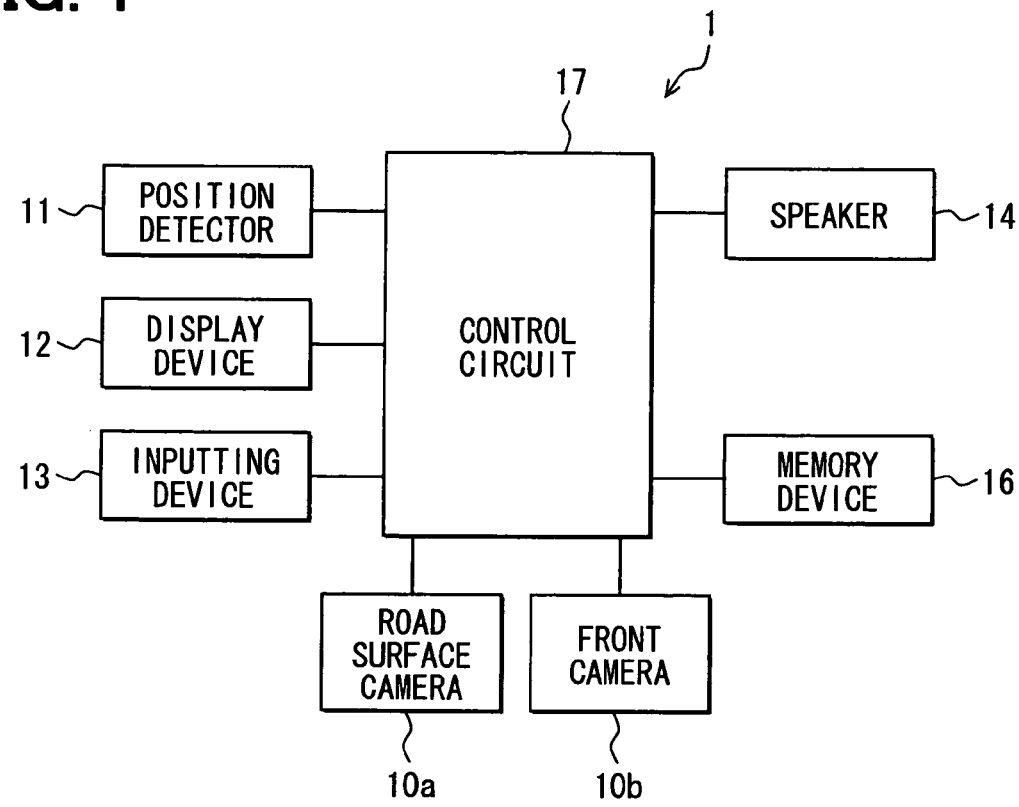
FIG. 1 is a block diagram showing an entire structure of a navigation system mounted on an automotive vehicle.

A preferred embodiment of the present invention will be described with reference to accompanying drawings. A device for informing a speed limit set for a driving lane to a driver is installed in a navigation system 1 mounted on an automotive vehicle. As shown in FIG. 1, the navigation system 1 includes: a camera 10*a* for taking a picture of a road surface in front of the vehicle (referred to as a road surface camera); a camera 10*b* for taking a picture of an upper portion in front of the vehicle (referred to as a front camera); a position detector 11, a display device 12; an inputting device 13; a speaker 14; a map data memory device 16; and a control circuit 17.

The road surface camera 10*a* is mounted in a front part of the vehicle, and it takes pictures of a front road surface repeatedly (e.g., 30 pictures per second). The pictures taken by the road surface camera 10*a* are sequentially fed to the control circuit 17. The road surface camera 10*a* can take pictures of a road surface of a lane on which an own vehicle is driving (referred to as an own lane) and pictures of a road surface of a left lane and a right lane of the own lane (referred to as neighboring lanes).

The front camera 10*b* is also mounted in a front part of the vehicle, and it takes pictures of an upper part in front of the vehicle repeatedly (e.g., 30 pictures per second). The pictures taken by the front camera 10*b* are fed to the control circuit 17. The front camera 10*b* can take pictures of sign boards positioned at roadsides.

The position detector 11 is a known device for detecting a present position of the vehicle, and it includes a terrestrial magnetic sensor, a gyroscope, a vehicle speed sensor and a global positioning sensor. Signals for determining a position, a driving direction and a driving speed of the vehicle are fed to the control circuit 17. The display device 12 including a display panel displays information such as a map around the vehicle based on image signals supplied from the control circuit 17. The inputting device 13 is composed of mechanical switches and touch panel switches on the display panel. Various information and commands are inputted by a user through the inputting device 12 to the control circuit 17.

The map data memory device 16 includes a device for reading-out (or writing-in if possible) data stored in memory media such as DVD, CD or HDD. The memory media store programs performed by the control circuit 17, map data for route guidance or the like. The map data include road data and facility data. The facility data includes names, positions, genre of facilities. The road data include information about positions and kinds of links, positions and kinds of nodes, and connecting relations between the links and the nodes. The road data include a speed limit set for each lane included in a multi-lane road, each lane permitting driving in the same direction. The speed limit set for each lane may be the same, or may be different from one another.

The control circuit 17 is a known microcomputer including CPU, RAM, ROM, ROM, I/O and other components. The CPU performs processes for operating the navigation system according to a program stored in the memory device 16. In performing the processes, data stored in the RAM, ROM and the memory device 16 are read out. Data are written in the RAM and the memory device 16 if possible and when necessary. The CPU in the control circuit 17 communicates with the position detector 11, the display device 12, the inputting device 13, the memory device 16 and the speaker 14.

The processes performed by the control circuit 17 include a process for determining a present position of the vehicle, a process for displaying a map on the display panel, a process for calculating a route to a destination, and a process for guiding a driver to the destination. The present position and the driving direction of the vehicle are determined based on signals from the position detector 11 using a known map-matching technique. In the process for displaying a map, a map around a present position of the vehicle is displayed on the display panel. The map data are read out from the memory device 16. In the process of calculating a route to a destination, a most appropriate route from the present position to a destination inputted by a user is calculated. In the process for guiding the driver to a destination, a right turn or a left turn is indicated to the driver from the speaker 14 when the vehicle is approaching an intersection or a point to be guided. An enlarged map of the guiding points including the intersections is displayed when the vehicle is approaching the guiding points.

Figure 2:
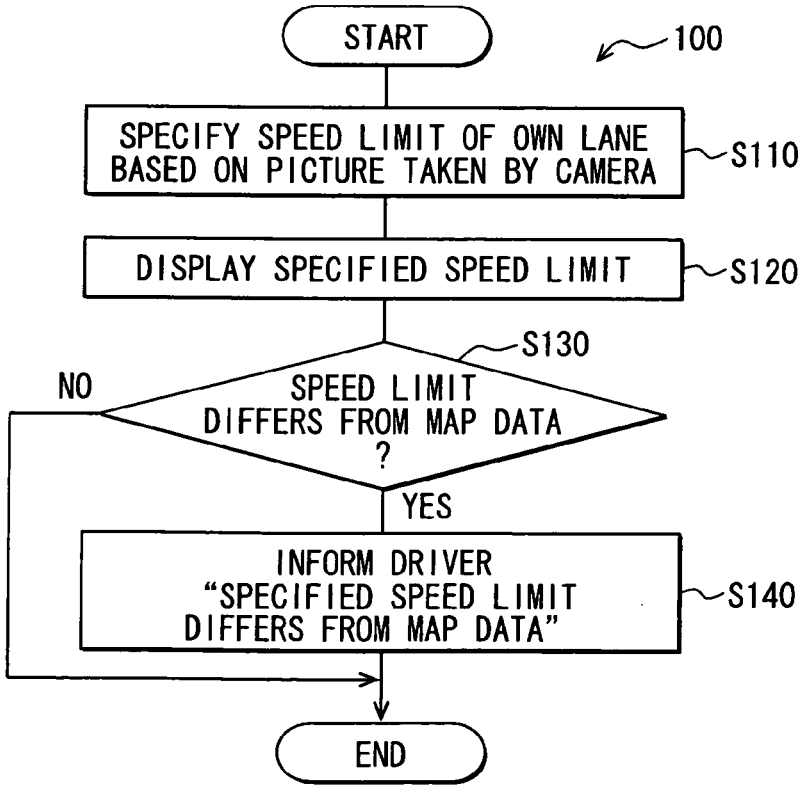
FIG. 2 is a flowchart showing a process for displaying a speed limit set for an own lane.
Figure 3:
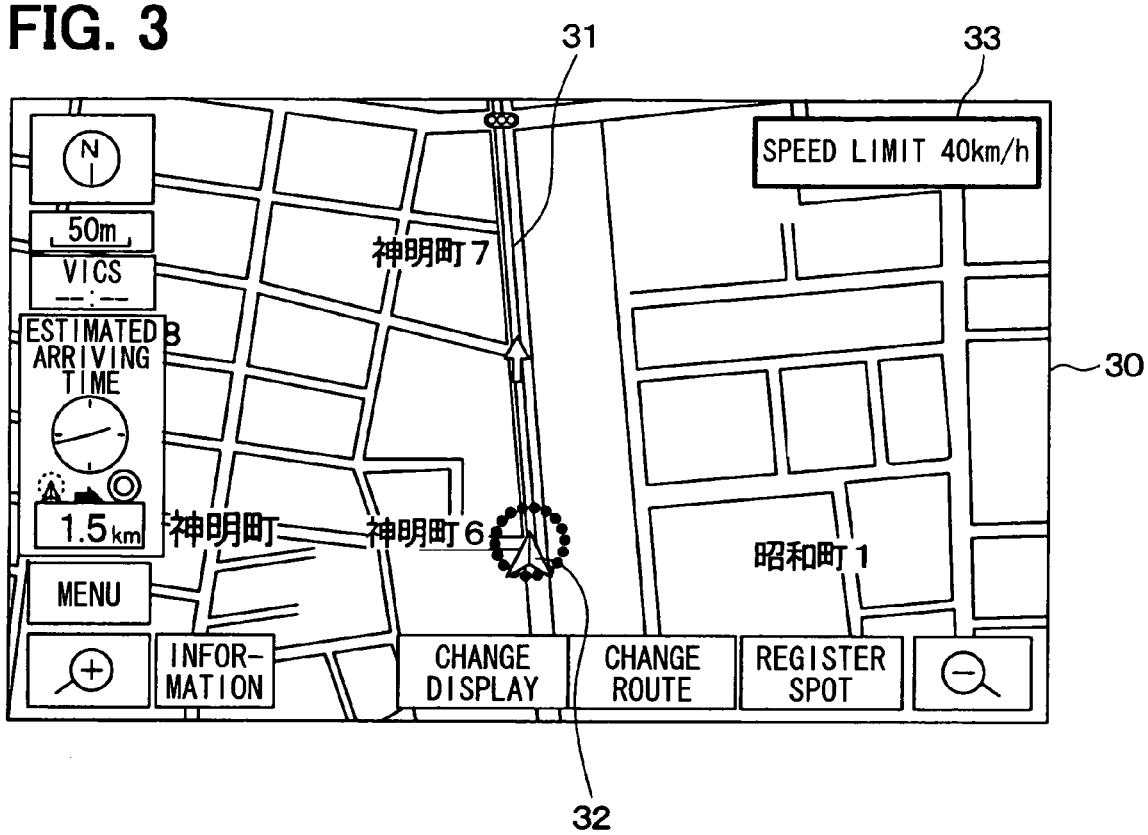
FIG. 3 is an example showing a display, in which a speed limit set for an own lane is shown.

With reference to FIG. 2, a process 100 for displaying a speed limit set for an own lane will be described in detail. At step S110, the control circuit 17 specifies a speed limit set for the own lane based on pictures taken by the road surface camera 10*a*. More particularly, the own lane is distinguished from neighboring lanes by detecting white lines separating the own lane from the neighboring lanes. Then, a mark showing the speed limit (painted numerals on the lane) is detected on a road surface of the own lane, using a known image-recognition technique. When the speed limit set for the own lane is successfully specified, the process proceeds to step S120. At step S120, the speed limit is displayed on the display panel in a manner exemplified in FIG. 3. In FIG. 3, a map 30 around the present position of the vehicle is shown, and the speed limit 33 set for the own lane is shown in an overlapped manner at an upper right corner of the display panel. A present position 32 of the own vehicle and a driving direction are shown on a multi-lane road 31.

Figure 4:
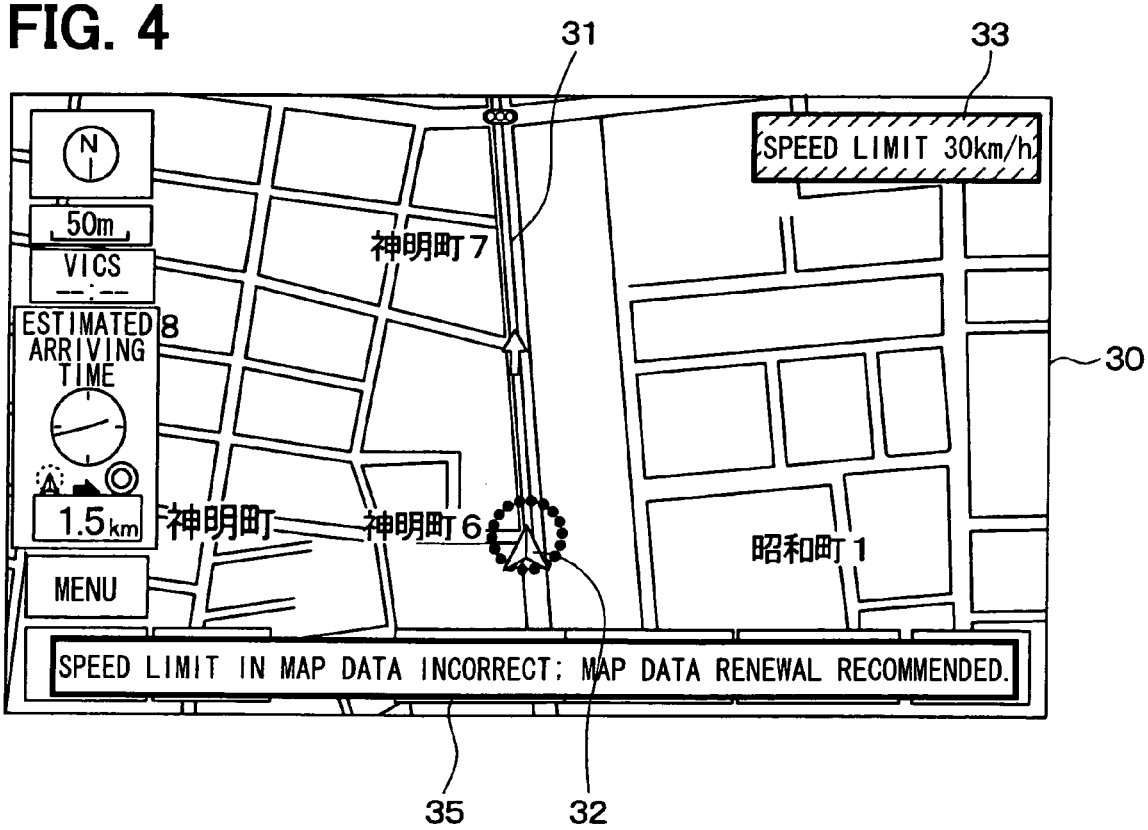
FIG. 4 is an example showing a display, in which a speed limit set for an own lane and a warning "SPEED LIMIT IN MAP DATA IS NOT CORRECT" is shown.

Then, at step S130, whether the speed limit specified based on the pictures taken by the road surface camera 10*a* is different from the speed limit read out from the map data stored in the memory device 16 is determined. If the specified speed limit is different from the speed limit stored in the map data, the process proceeds to step S140. At step S140, this fact is informed to the driver by displaying a warning 35 as exemplified in FIG. 4. The speed limit 33 specified from the pictures taken by the road surface camera 10*a* is shown at an upper right corner of the display, and the warning 35 is displayed at the bottom portion of the display in a manner overlapped with the displayed map 30. In this case, the speed limit 33 at the upper right corner may be shown with a color different from that shown in FIG. 3 to drawn attention of the driver. The fact that the specified speed limit is different from the stored data means that the stored data are old and incorrect. Therefore, the warning 35 includes a recommendation to renew the map data. After the step S140, the process comes to the end. If it is determined that the specified speed limit is not different from the stored data at step S130, the process comes to the end, completing one course of the process 100.

The process 100 is repeatedly performed. Since the speed limit set for the own lane is detected based on pictures taken by the road surface camera 10*a* and displayed on the display panel, the speed limit set for the own lane is readily notified to the driver. If the speed limit detected by the road surface camera 10*a* is different from that stored in the memory device 16, a warning showing this fact is displayed on the display panel to thereby recommend renewing the map data (by replacing a map data disk or rewrite the map data).

Instead of detecting the speed limit base on the pictures taken by the road surface camera 10*a*, it is also possible to retrieve the speed limit from the map data stored in the memory device 16. However, in this case, it is necessary to keep the map data always updated to avoid informing the driver of false (old) information. It is also necessary to detect the own lane among plural lanes included in a multi-lane road, requiring a sophisticated high technique. On the contrary, it is not necessary to detect the own lane using a highly sophisticated technique in the process 100 described above, because the speed limit is found by the road surface camera 10*a* mounted on the own vehicle driving on the own lane.

Figure 5:
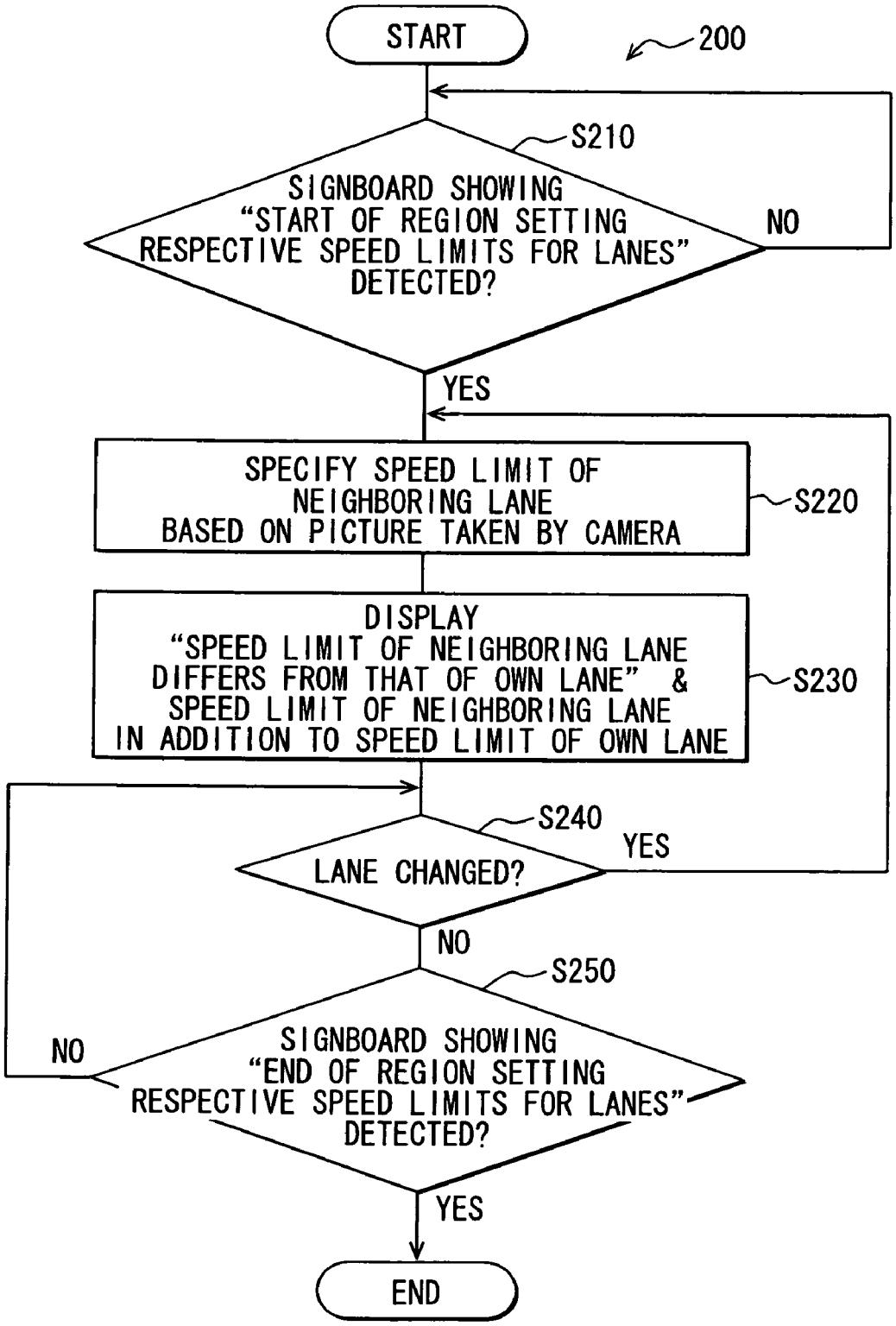
FIG. 5 is a flowchart showing a process for displaying a speed limit set for neighboring lanes.

The control circuit performs a process 200 shown in FIG. 5 in parallel to the process 100 shown in FIG. 2. In the process 200, speed limits set for lanes neighboring to the own lane are detected and displayed on the display panel. At step S210, detection of a signboard showing a start of a region, in which respective speed limits are set for each lane, is repeatedly tried. Detection of the signboard is performed by comparing pictures taken by the front camera 10*b* with an image showing the signboard stored in the memory device 16 using a known image recognition technique. If such a signboard is detected, the process proceeds to step S220.

At step S220, a speed limit set for a neighboring lane is detected based on pictures taken by the road surface camera 10*a*. More particularly, the neighboring lane is specified by finding a white line between the own lane and the neighboring lane using a known image recognition technique. Then, numerals showing the speed limit painted on the neighboring lane are detected using a known character recognition technique. At step S230, whether the speed limit of the neighboring lane is different from the speed limit of the own lane that is finally specified by repetition of the process 100 (shown in FIG. 2) is determined. If the speed limits are different between the own lane and the neighboring lane (or neighboring lanes), that fact is displayed on the display panel together with numerals showing the speed limits.

Figure 6:
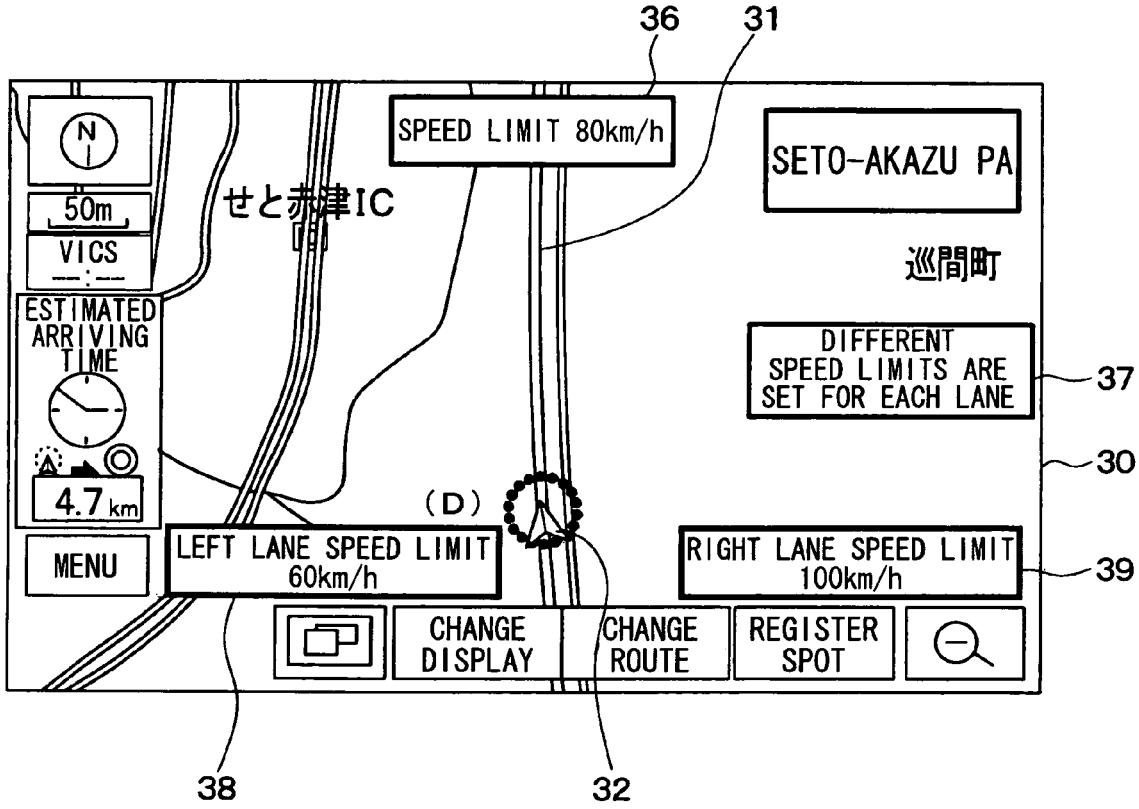
FIG. 6 is an example showing a display, in which a speed limit set for an own lane and speed limits set for neighboring lanes are shown.

As exemplified in FIG. 6, the speed limits of the own lane and the neighboring lanes and a message informing that different speed limits are set for each lane are displayed in an overlapped manner on the displayed map 30 around a present position of the vehicle. In the example shown in FIG. 6, the present position of the own vehicle 32 driving on the multi-lane road 31 is shown. The speed limit 36 (80 km/h) set for the own lane is shown in an upper middle portion of the display panel, the speed limit 38 (60 km/h) set for the left neighboring lane at a bottom left corner, and the speed limit 39 (100 km/h) set for the right neighboring lane at a bottom right corner.

Further, a notification 37 informing that different speed limits are set for each lane is shown at a middle portion of the right side of the display panel.

At step S240, whether the driving lane (own lane) is changed or not is determined. If the driving lane is changed, the process returns to step S220 to repeat the steps S220 and S230. The determination of the lane change may be made according to a signal from a winker switch or the position detector 11. If it is determined that the driving lane is not changed at step S240, the process proceeds to step S250. At step S250, whether a signboard informing an end of the region where the respective speed limits are set for each lane is found or not is determined according to pictures taken by the front camera 10*b*. This determination is made in the same manner as in step S210. If the signboard is found, the process comes to the end of a series of steps. If not, the process returns to step S240.

In the process 200, a region where different speed limits are set for each lane is detected by finding the signboards showing its beginning and end. The speed limits set for the neighboring lanes are specified in the region. If it is detected that the speed limits set for the neighboring lanes are different from that of the own lane, the notification informing that fact and the speed limits set for the neighboring lanes are displayed together with the speed limit set for the own lane. Driver's attention is drawn to the fact that the speed limits set for the neighboring lanes are different from that of the own lane, contributing to promotion of traffic safety. Further, the driver may change the driving lane to a faster lane if he/she wants to drive faster according to the notification displayed. This promotes driving convenience.

The steps (S220 and S230) for specifying the speed limits set for the neighboring lanes and for displaying the notification notifying that the speed limits set for the neighboring lanes are different from that of the own lane are performed again only when the driver changes the driving lane. In this manner, increase in operating load for the control circuit 17 is suppressed, while maintaining appropriate displays on the display panel.

The notification informing that the different speed limits are set is displayed only when the speed limit for the neighboring lane that is different from the speed limit for the own lane is actually specified. In other words, the notification is not displayed when the vehicle simply enters the region where the different speed limits are to be set. For example, in the case where the own vehicle is driving on the left most lane in a multi-lane road having five lanes in one direction, and a speed limit of 60 km/h is set for two left lanes and a speed limit of 80 km/h is set for three right lanes, the notification is not displayed because the lane neighboring to the own lane has the same speed limit. Further, the speed limit set for only the neighboring lane is displayed and the speed limits set for other lanes (far apart lanes) are not displayed. In this manner, display of excessive information that is troublesome to the driver is avoided.

The speed limits set for the own lane and neighboring lanes are specified based on pictures taken by the road surface camera 10*a*. Therefore, only updated information of the speed limits is used, as opposed to the case where the speed limit information stored in the memory device is used. In addition, the own lane is automatically determined because the on-board camera 10*a* is used. It is not necessary to detect the own lane by a sophisticated technique.

The present invention is not limited to the embodiment described above, but it may be variously modified. For example, the speed limit of the own lane, the speed limits of the neighboring lanes, the warning 35 (FIG. 4) and the notification 37 (FIG. 6) are all displayed on the display panel in an overlapped manner with the displayed map 30 in the foregoing embodiment. However, these pieces of information may be outputted from the speaker 14.

It is also possible to detect whether the speed limit of the neighboring lane stored in the memory device 16 is different from that specified according to pictures taken by the road surface camera 10*a*. If this is the case, a warning informing the driver that the speed limit stored in the memory device is incorrect and recommending to renew the map data may be displayed on the display panel. It is also possible, at step S230 (FIG. 5), to display the notification notifying that the different speed limits are set for each lane and the speed limit set for one neighboring lane, eliminating display of the speed limit set for another neighboring lane.

The program-performing functions of the control circuit 17 may be replaced with hardware performing respective functions (such as FPGA). It is not essential to the present invention to calculate the driving route and to perform the route guidance. It is essential to the present invention to specify the speed limit and inform it to the driver.

While the present invention has been shown and described with reference to the foregoing preferred embodiment, it will be apparent to those skilled in the art that changes in form and detail may be made therein without departing from the scope of the invention as defined in the appended claims.

What is claimed is:

1. An on-board device for informing a speed limit set for an own lane, on which an own vehicle is driving, the own lane being included in a multi-lane road, the on board device comprising a control circuit configured to:

specify the speed limit set for the own lane; and inform the specified speed limit to a driver; wherein the control circuit further specifies a speed limit set for a neighboring lane of the own lane; and the control circuit informs the driver that the speed limit set for the neighboring lane is different from the speed limit of the own lane when such is the case.

2. The on-board device as in claim 1, wherein:

the control circuit specifies the speed limit set for the own lane based on a picture, showing the speed limit set for the own lane, taken by an on-board camera.

3. The on-board device as in claim 2, further comprises a memory readout device for reading out information regarding speed limits set for respective lanes included in the multi-lane road from a memory device storing the information regarding speed limits set for the respective lanes, wherein:

the control circuit further informs the driver that the specified speed limit set for the own lane based on the picture taken by the on-board camera is different from a speed limit set for the own lane read out from the memory device, if such is the case.

4. The on-board device as in claim 2, further comprising a display panel on which informed information is shown.

5. The on-board device as in claim 2, wherein:

the control circuit specifies the speed limit set for the neighboring lane based on a picture, showing the speed limit set for the neighboring lane, taken by the on-board camera.

6. The on-board device as in claim 1, wherein:

the control circuit further informs the driver of the speed limit set for the neighboring lane.

7. The on-board device as in claim 6, wherein:

the control circuit further informs the driver of the speed limit set for neighboring lanes at both sides of the own lane, if such is the case.

8. The on-board device as in claim 1, wherein:

the control circuit further specifies the speed limit set for the neighboring lane based on a picture, showing the speed limit set for the neighboring lane, taken by an on-board camera.

9. A memory medium for storing a computer program for operating the control circuit defined in claim 1.

10. An apparatus, in a vehicle, for displaying a first speed limit of a first lane and an adjacent speed limit of an adjacent lane of a multi-lane road, the vehicle traveling in the first lane, the apparatus comprising:

a display device; and a control circuit configured to determine the first speed limit of the first lane and determine the adjacent speed limit of the adjacent lane, control the display device to display the first speed limit of the first lane, determine whether the first speed limit of the first lane and the adjacent speed limit of the adjacent lane are different, and when it is determined that the first speed limit of the first lane and the adjacent speed limit of the adjacent lane are different, control the display device to display an indication that the first speed limit of the first lane and the adjacent speed limit of the adjacent lane are different.

11. The apparatus of claim 10, further comprising:

an on-board camera, wherein the control circuit determines the first speed limit of the first lane based on a first image, showing an indication of the first speed limit, taken by the on-board camera.

12. The apparatus of claim 11, wherein:

the control circuit determines the adjacent speed limit of the adjacent lane based on an adjacent image, showing an indication of the adjacent speed limit, taken by the on-board camera.

13. The apparatus of claim 11, further comprising:

a memory reading device, wherein the control circuit is further configured to control the memory reading device to read first information indicating the first speed limit from a memory storage device, compare the first speed limit based on the first image taken by the on-board camera with the first speed limit indicated by the first information, and when the first speed limit based on the first image taken by the on-board camera is different from the first speed limit indicated by the first information, control the display device to display an indication that the first speed limit based on the first image taken by the on-board camera is different from the first speed limit indicated by the first information.

14. The apparatus of claim 13, wherein the indication that the first speed limit based on the first image taken by the on-board camera is different from the first speed limit indicated by the first information includes a message that the first information stored in the memory storage device should be updated.

15. The apparatus of claim 10, wherein:

the control circuit is further configured to control the display device to display the adjacent speed limit of the adjacent lane.

16. A memory medium for storing a computer program for operating the control circuit defined in claim 10.

* * * * *